US008215244B2

(12) United States Patent
Apps

(10) Patent No.: US 8,215,244 B2
(45) Date of Patent: Jul. 10, 2012

(54) PLASTIC PALLET

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 12/961,570

(22) Filed: Dec. 7, 2010

(65) Prior Publication Data

US 2011/0073018 A1 Mar. 31, 2011

Related U.S. Application Data

(63) Continuation of application No. 11/099,423, filed on Apr. 4, 2005, now Pat. No. 7,845,289, which is a continuation of application No. 10/028,481, filed on Dec. 18, 2001, now Pat. No. 6,874,428.

(51) Int. Cl.
*B65D 19/00* (2006.01)

(52) U.S. Cl. ..... 108/57.25

(58) Field of Classification Search ..... 108/57.25, 108/57.26, 57.27, 901, 902, 51.11
See application file for complete search history.

(56) References Cited

U.S. PATENT DOCUMENTS

| | | | |
|---|---|---|---|
| 2,991,965 | A | 7/1961 | Drieborg |
| 3,126,843 | A | 3/1964 | DeLaney |
| 3,327,654 | A | 6/1967 | Duncan et al. |
| 3,481,285 | A | 12/1969 | Yellin |
| D221,636 | S | 8/1971 | Moses |
| 3,626,869 | A | 12/1971 | Colas |
| 3,638,586 | A | 2/1972 | Elshout |
| 3,720,176 | A | 3/1973 | Munroe |
| 3,759,194 | A | 9/1973 | Fujii et al. |
| 3,795,206 | A | 3/1974 | Utz |
| 3,938,448 | A | 2/1976 | Nishitani et al. |
| 4,051,787 | A | 10/1977 | Nishitani et al. |
| D246,296 | S | 11/1977 | Fujii et al. |
| 4,230,050 | A | 10/1980 | Mays |
| 4,230,051 | A | 10/1980 | Mays |
| D279,617 | S | 7/1985 | Helmer |
| D283,073 | S | 3/1986 | Marshall |
| 4,606,278 | A | 8/1986 | Shuert |
| D288,978 | S | 3/1987 | Wind |
| D296,599 | S | 7/1988 | Bean |
| 4,972,782 | A | 11/1990 | Shepherd et al. |
| D347,511 | S | 5/1994 | Pigott et al. |
| D357,108 | S | 4/1995 | Hutchison |

(Continued)

FOREIGN PATENT DOCUMENTS

| | | |
|---|---|---|
| DE | 26 13 083 | 6/1977 |

(Continued)

*Primary Examiner* — Jose V Chen
(74) *Attorney, Agent, or Firm* — Carlson, Gaskey & olds

(57) ABSTRACT

A pallet has a top deck member and a bottom deck member. The top deck member has an upper surface, and a lower surface defined by a plurality of first cross-rib members. The bottom deck member has an upper portion and runners extending downwardly therefrom in a unitary construction. The upper portion has an upper surface defined by a plurality of second cross-rib members which correspond to the first cross-rib members and securely attached to mount the top and bottom decks to each other. The runners have a lower surface and extend transversely across the pallet in a parallel orientation, and also have a plurality of upright members and support members extending between the upright members and integrally formed therewith in a unitary construction. The plurality of second cross-rib members extend generally vertically from the top deck to the lower surface of the runners.

14 Claims, 20 Drawing Sheets

U.S. PATENT DOCUMENTS

| | | | | |
|---|---|---|---|---|
| 5,413,052 | A | 5/1995 | Breezer et al. | |
| 5,427,019 | A | 6/1995 | Moorman | |
| 5,433,156 | A | 7/1995 | Hutchison | |
| D367,145 | S | 2/1996 | Hamilton | |
| D370,762 | S | 6/1996 | Young, Jr. et al. | |
| D371,882 | S | 7/1996 | Kristofferson | |
| D379,716 | S | 6/1997 | Zipperle et al. | |
| 5,690,037 | A | 11/1997 | Hill | |
| 5,736,221 | A | 4/1998 | Hardigg et al. | |
| 5,806,436 | A | 9/1998 | Weichenrieder, Sr. et al. | |
| 5,845,588 | A | 12/1998 | Gronnevik | |
| 5,868,080 | A | 2/1999 | Wyler et al. | |
| 5,894,803 | A | 4/1999 | Kuga | |
| D411,682 | S | 6/1999 | Edwards et al. | |
| 5,918,551 | A | 7/1999 | Liu | |
| 5,937,767 | A | 8/1999 | Togawa et al. | |
| 5,967,057 | A | 10/1999 | Nakayama et al. | |
| D428,679 | S | 7/2000 | Bridge | |
| 6,095,061 | A | 8/2000 | Perazzo | |
| 6,125,770 | A | 10/2000 | Brandenburg | |
| 6,173,657 | B1 | 1/2001 | Espejo | |
| 6,199,488 | B1 | 3/2001 | Favaron et al. | |
| 6,250,234 | B1 | 6/2001 | Apps | |
| D445,554 | S | 7/2001 | Blason et al. | |
| D445,985 | S | 7/2001 | Paxton | |
| D446,900 | S | 8/2001 | Koefelda | |
| 6,283,044 | B1 | 9/2001 | Apps | |
| D452,057 | S | 12/2001 | French et al. | |
| D453,057 | S | 1/2002 | Sewell | |
| 6,354,230 | B1 | 3/2002 | Maschio | |
| 6,357,366 | B1 | 3/2002 | Frankenberg | |
| D458,000 | S | 5/2002 | Medoff et al. | |
| D476,789 | S | 7/2003 | Apps et al. | |
| D479,379 | S | 9/2003 | Yamanouchi et al. | |
| 6,874,428 | B2 * | 4/2005 | Apps | 108/57.25 |
| 7,845,289 | B2 * | 12/2010 | Apps | 108/57.25 |

FOREIGN PATENT DOCUMENTS

| | | |
|---|---|---|
| DE | 27 33 457 | 7/1977 |
| DE | 32 05 910 | 11/1983 |
| DE | 91 03 462 | 6/1991 |
| DE | 43 36 469 | 5/1994 |
| EP | 0 301 445 | 7/1987 |
| EP | 0 979 778 | 2/2000 |
| GB | 1 310 898 | 3/1973 |
| WO | 00/01588 | 1/2000 |
| WO | 00/06458 | 2/2000 |

* cited by examiner

PLASTIC PALLET

CROSS-REFERENCE TO RELATED APPLICATIONS

This application is a continuation of U.S. application Ser. No. 11/099,423, filed on Apr. 4, 2005, now U.S. Pat. No. 7,845,289, which is a continuation of U.S. application Ser. No. 10/028,481, filed on Dec. 18, 2001, now U.S. Pat. No. 6,874,428.

BACKGROUND OF THE INVENTION

1. Field of the Invention

This invention relates to a plastic pallet for supporting goods.

2. Background Art

Many plastic pallets used today have top and bottom horizontal decks connected by a series of posts, between which the forks of a lift truck or pallet jack are inserted. While these types of pallets may be functional, strong, and have the desired stiffness, they typically have a large package height and thus may use more material and be heavier than what the application requires. One example of this type of pallet is disclosed in U.S. Pat. No. 6,283,044 by the inventor of the present invention, and assigned to the assignee of the present invention. Other types of pallets, such as the stringer pallet design, often have a lower profile package height, but may also not be as strong as desired. Moreover, such pallets may not provide sufficient racking strength when they are subjected to load under a racking scenario. The rack load is the load-carrying capacity and deflection of a pallet which is supported by a rack frame near the ends of the pallet.

Accordingly, a plastic pallet is desired which is lighter and less expensive than a pallet having complete upper and lower decks with posts disposed therebetween, while providing sufficient strength and durability and also providing a desired rack load capacity.

SUMMARY OF THE INVENTION

Thus, it is a goal according to the present invention to provide a plastic pallet which is lighter and less expensive than other pallets, while providing sufficient strength, durability, and also provides the desired rack load capacity.

It is another object according to the present invention to provide a plastic pallet which is formed in two pieces, each of which have a unitary construction.

In accordance with the objects and goals of the present invention, provided is a pallet having a top deck member and a bottom deck member. The top deck member has an upper surface, and also has a lower surface defined by a plurality of first cross-rib members. The bottom deck member has an upper portion and a plurality of runners extending downwardly from the upper portion in a unitary construction. The upper portion has an upper surface defined by a plurality of second cross-rib members corresponding generally to the first cross-rib members and attached to the first cross-rib members to securely attach the top deck and bottom deck to each other. The runners have a lower surface and extend transversely across the pallet in a generally parallel orientation. The runners have a plurality of upright members and support members extending between the upright members and integrally formed therewith in a unitary construction. The plurality of second cross-rib members extend generally vertically from the top deck to the lower surface of the runners.

In one embodiment, the support members of the pallet has an upper support surface and a lower support surface, and one of the upper support and lower support surfaces is defined by a plurality of rib members. In the embodiment shown, the lower support surface is defined by a plurality of rib members. The first and second cross-rib members are preferably attached to each other by a welding process, and preferably hot-plate welding. Also, the bottom surfaces of the upright members and support members are co-planar. These features may apply to any of the pallets provided according to the invention herein.

Moreover, one of the pallet mating surfaces has a locating member projecting therefrom, and the other of the first and second mating ribbed surfaces has a recess formed therein for receiving the locating member therein to aid in aligning the upper and lower decks. The pallet may also have at least one reinforcement member extending between the upper deck portion and lower deck portion, wherein at least one of the lower surface of the upper deck portion and the upper surface of the lower deck portion have at least one channel formed therein for receiving the reinforcement member therein.

Another pallet provided according to the present invention includes a first deck member and a second deck member. The first deck member has an upper surface arranged for receiving a load thereupon, and a also has lower surface having a first plurality of cross-ribs. The second deck member has a horizontally disposed upper portion with a lower surface, and an upper surface defined by a second plurality of cross-ribs which correspond generally to and mate with the first plurality of cross-ribs. The second deck further has a lower portion integrally formed with the upper portion to form a unitary construction therewith. The lower portion extends downwardly from the upper portion and is defined by a plurality of generally parallel runners for supporting the pallet. The runners are spaced apart from each other to define openings therebetween. Each runner has a plurality of post members and at least one support member extending between the bottom of the post members for interconnecting the posts members in a unitary construction.

Another pallet provided according to the present invention includes an upper deck portion having a first mating cross-ribbed surface, and a load surface opposite the first mating ribbed surface. The pallet also includes a lower deck portion having a second mating ribbed surface defined by a plurality of rib members, a lower surface opposite the second mating ribbed surface, and a plurality of generally parallel legs extending downwardly from the lower surface to form a unitary construction. The legs are spaced apart from each other to define pallet openings therebetween. The legs have at least one post member within which some of the plurality of rib members extend to a bottom surface of the at least one post member, and a foot portion extending across a bottom of the at least one post member and forming a unitary construction therewith. The first and second mating ribbed surfaces are mounted to each other for securing the upper deck portion and lower deck portion together.

Further provided is a first deck member having a plurality of first cross-rib members forming first partial box-beam sections. A second deck member has second cross-rib members forming second partial box beam sections and corresponding generally to the first cross-rib members, the first and second mating surfaces attached to form box-beam sections between the first deck member and second deck member. The second deck member further includes a plurality of runners projecting downwardly from the second mating surface in a unitary construction and extending transversely across the second deck member in a generally parallel orientation, the runners further having a plurality of post members and support members extending between the post members and integrally formed therewith in a unitary construction. The plurality of second cross-rib members extend between the second mating surface and a lower portion of the runners.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
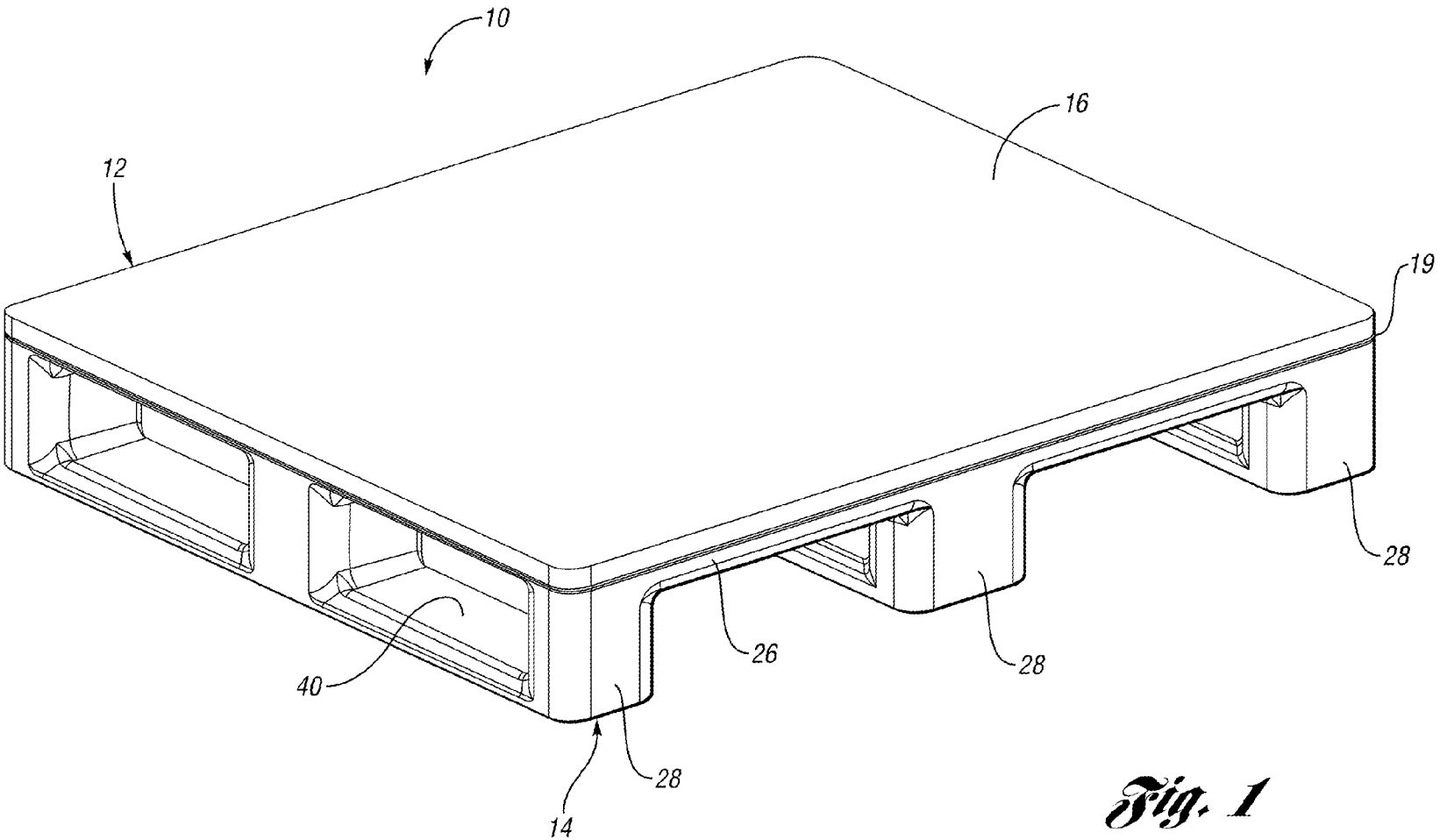
FIG. 1 is a perspective view of a pallet according to the present invention.
Figure 2:
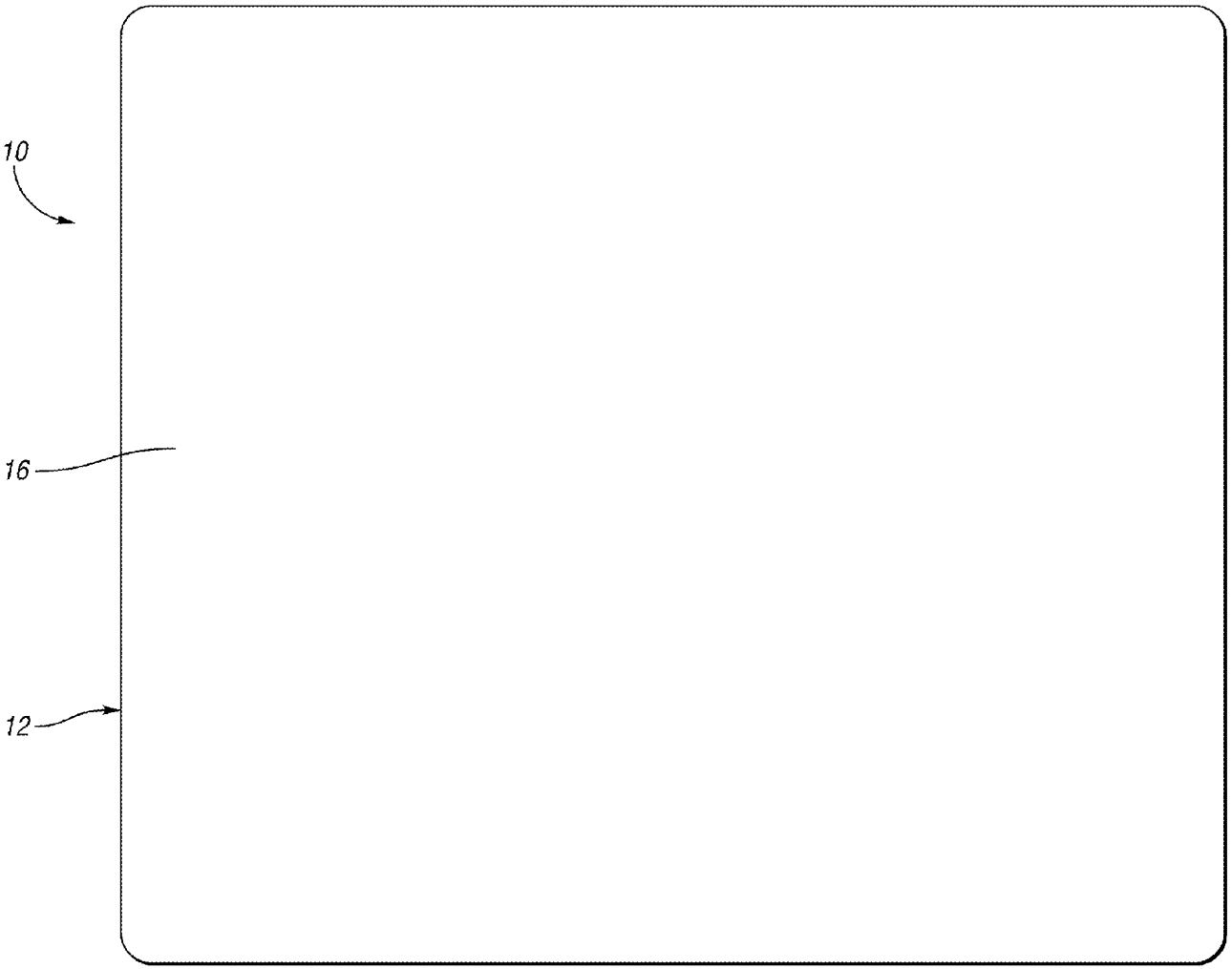
FIG. 2 is a top plan view of the pallet.

FIGS. 1-13 illustrate a pallet 10 in accordance with the present invention. As best shown in the exploded view of FIG. 6, pallet 10 includes a top deck member 12 (first deck or upper deck) and a bottom deck member 14 (second deck or lower deck). Top deck 12 and bottom deck 14 are preferably molded from a plastic material such as polypropylene via an injection molding process, but of course may be formed of various polymeric materials and processes to achieve the desired characteristics. Pallet 10 is shown as having a generally rectangular shape and also as being generally symmetrical about its centerlines. However, it is fully contemplated that pallet 10 may have various shapes and configurations without departing from the teachings of the present invention. FIGS. 2, 3, 4, and 5 illustrate respectively a top plan view, bottom plan view, front elevational view, and side elevational view of pallet 10.

Figure 8:
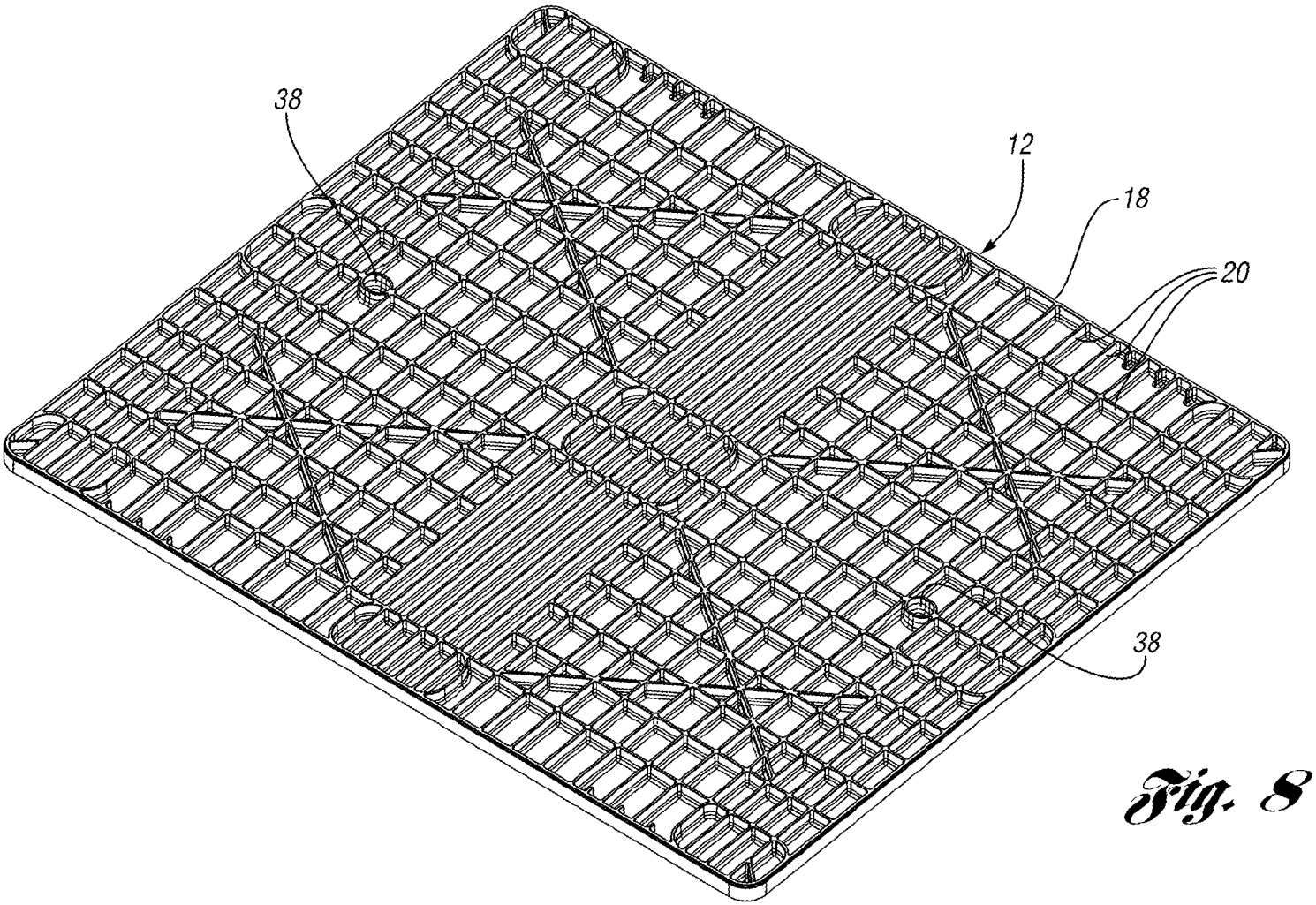
FIG. 8 is a front elevational view of the pallet showing the top deck spaced apart from the bottom deck.

Top deck 12 is a generally planer and horizontally disposed member having an upper surface 16 (FIGS. 1-2) and a lower surface 18 (FIG. 8). Top surface 16 of top deck 12 is illustrated as having a flat continuous surface, but of course may also include drain holes, grommets, etc. without departing from the teachings herein. As shown in FIG. 8, lower surface 18 of top deck 12 is defined by a plurality of rib 20 members, including multi-directional cross-ribbing, for providing strength to top deck 12, as well as providing a means to attach top deck 12 to bottom deck 14 as explained more fully herein.

Figure 3:
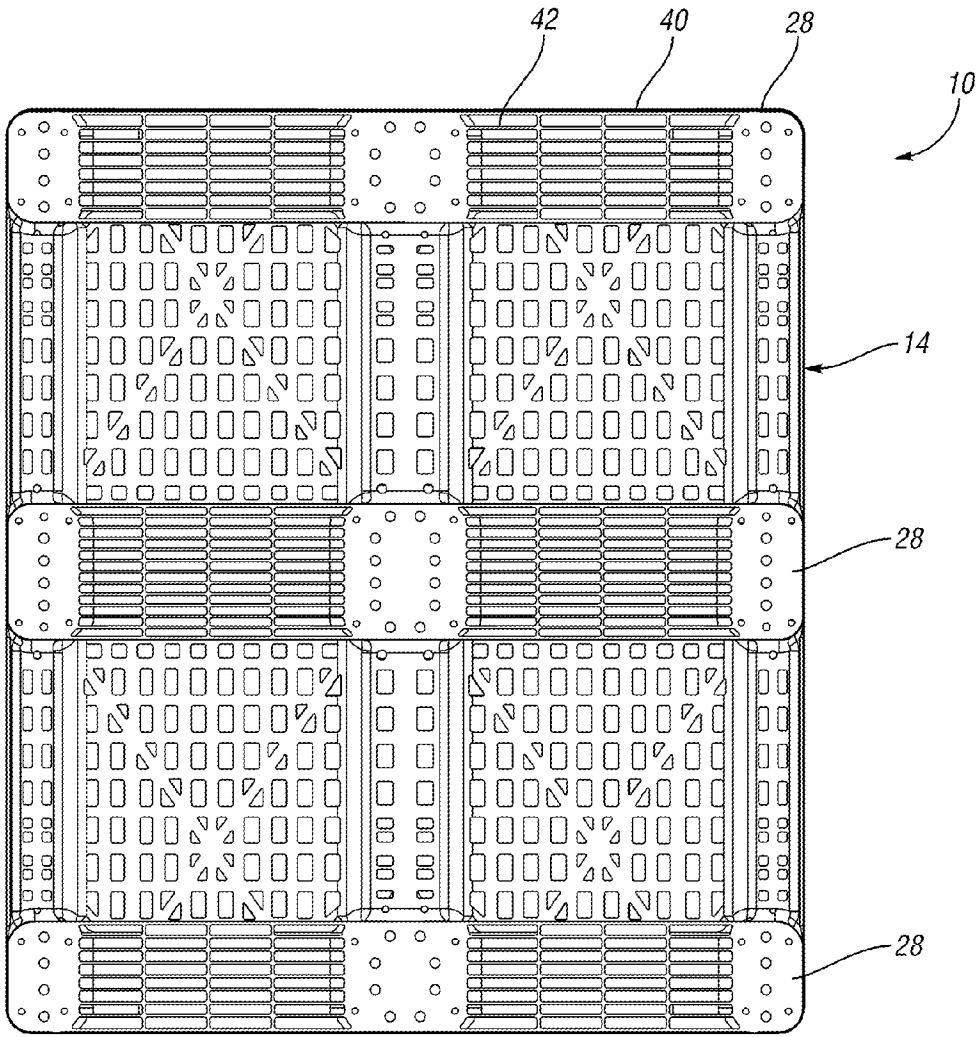
FIG. 3 is a bottom plan view of the pallet.
Figure 4:
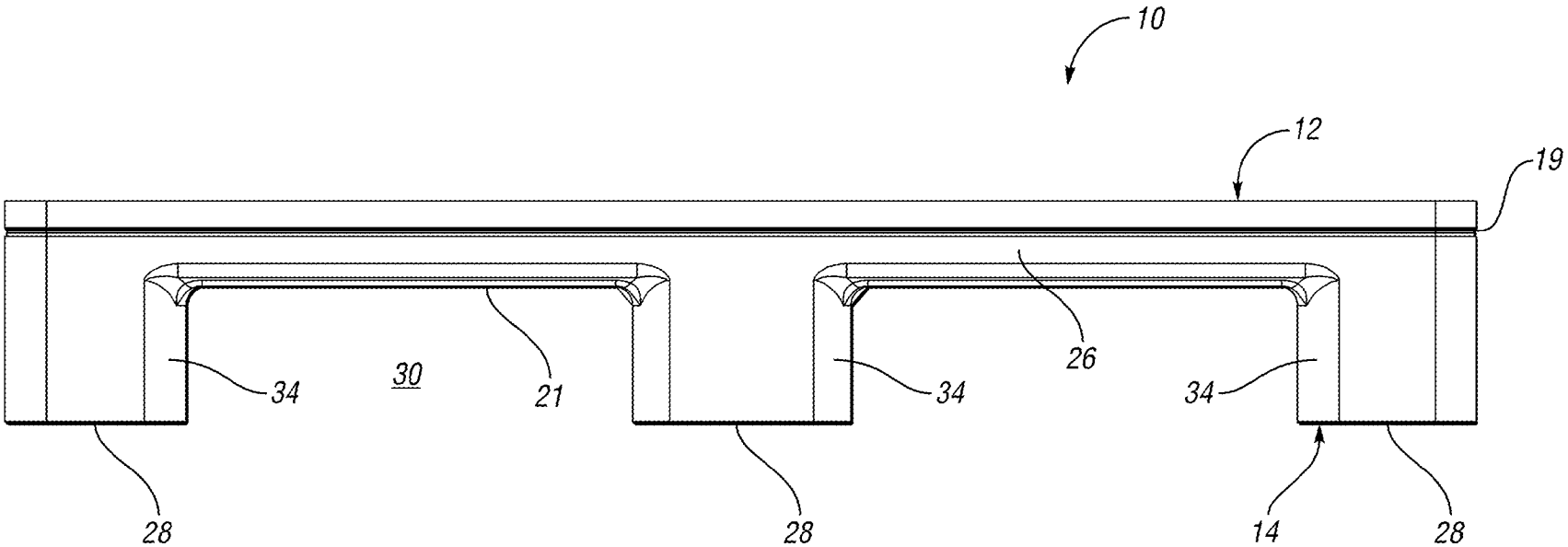
FIG. 4 is a front side elevational view of the pallet, the rear side elevational view being a minor image thereof.
Figure 5:
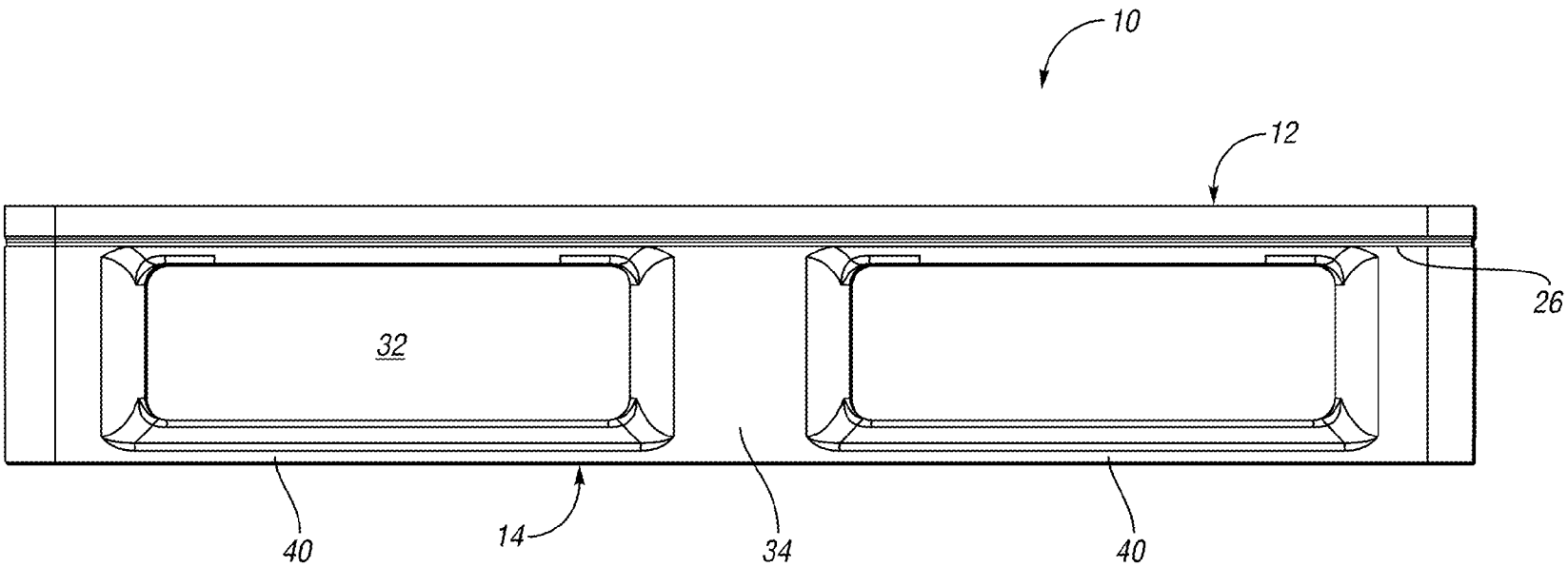
FIG. 5 is a right elevational view of the pallet, the left elevational view being a minor image thereof.
Figure 6:
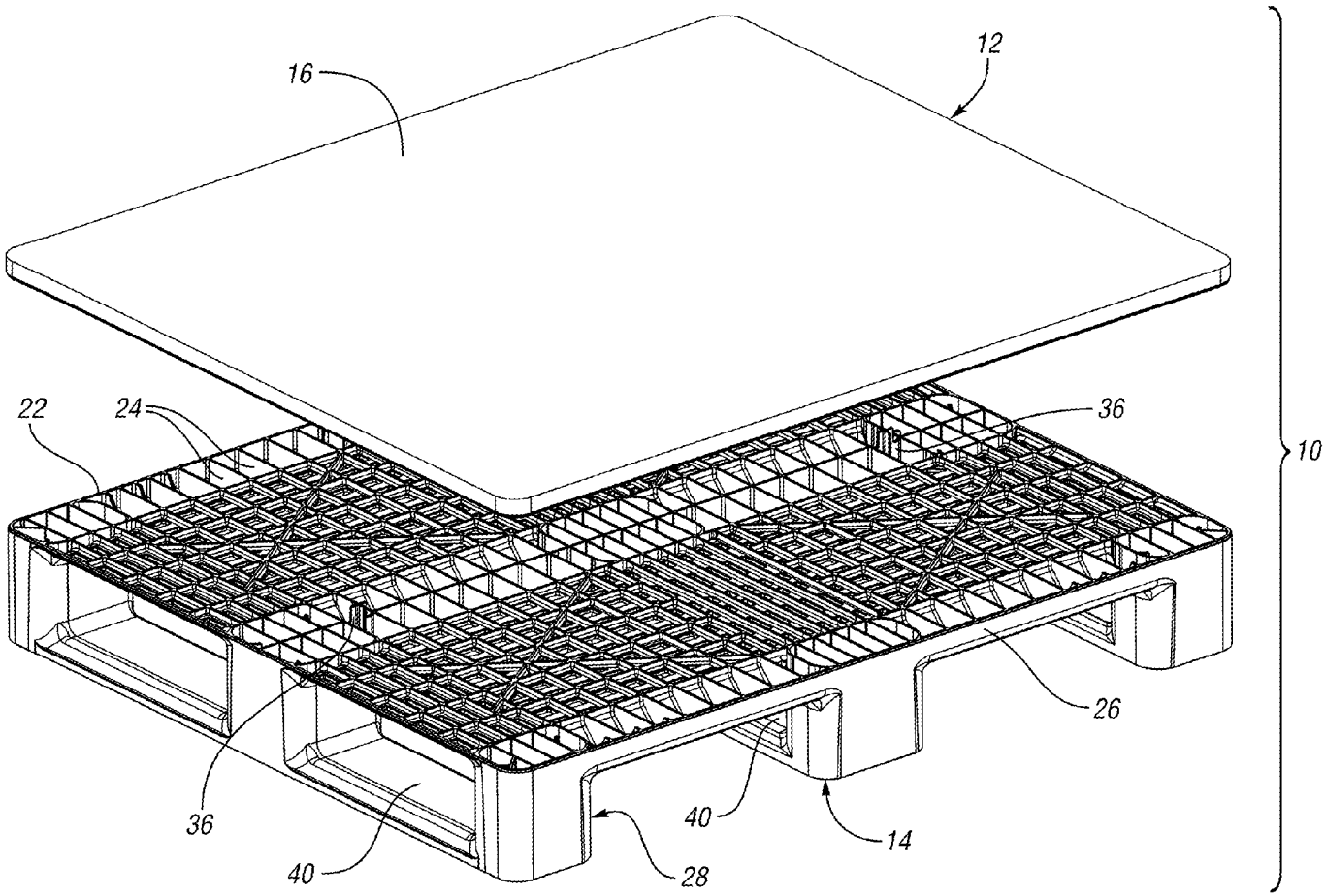
FIG. 6 is a perspective view of the pallet showing the top deck spaced apart from the bottom deck.

With reference to FIGS. 3 and 6, bottom deck 14 includes an upper horizontally disposed portion 26 and a plurality of runners 28 projecting downwardly there from, each runner 28 extending transversely across bottom deck 14. Each runner 28 includes a plurality of vertically disposed (upstanding) post members 34 and a plurality of lower horizontally disposed support members 40 extending transversely between the post members, wherein the upper portion 26, posts 34 and the support members 40 are integrally formed together as a unitary member. Pallet 10 is shown having three runners 28 extending thereacross. Upper portion 26 has a lower surface 21 and also has an upper surface 22 which corresponds generally to lower surface 18 of top deck 12. Upper portion is noted to be relatively larger in FIG. 4 than in FIG. 5. More particularly, upper surface 22 has a plurality of ribs 24, including cross-ribs, which correspond to ribs 20 of upper deck 12. Upper portion 26 and runners 28 define along the front and rear sides of pallet 10 a series of notches 30 which are capable of receiving the forks of a pallet hand track, for lifting and handling pallet 10. Along the left and right sides of pallet 10, runners 28 and upper portion 26 define a series of openings 32 for receiving the forks of a forklift.

As illustrated in FIG. 3, support members 40 assist in defining the bottom surface of the pallet, and includes a plurality of cross-ribbing 42 in order to provide strength and torsional stiffness to those areas, while the upper surface of support members 40 is generally flat and continuous.

As shown in FIGS. 10*a* through 13*b*, mating ribbed surfaces 18 and 22 of upper deck 12 and lower deck 14 are securely attached to each other by any of various methods known in the art, such as plastic welding, for example hot plate welding, sonic welding, or infrared radiation welding, as disclosed in U.S. Pat. Nos. 6,250,234 and 6,283,044, each of which is incorporated by reference fully herein. The mating surfaces 18, 20 are defined by a plurality of corresponding flanged or ribbed members 22, 24 which are generally oriented in a multi-directional cross-ribbing orientation, and which when mounted together form a plurality of box beam sections between the upper and lower decks. If attached by a welding process, ribbed surfaces are heated to a point of plasticizing the plastic surfaces, and then are introduced to each other and held together for a period of time by which a welded bond will form between the surfaces for securing the decks together, forming a parting line 19. As illustrated in FIG. 11, note ribs 24 of bottom deck 14 extend vertically through areas adjacent upper portion 26, such as through runners 28, and the post members 34 thereof.

Figure 9:
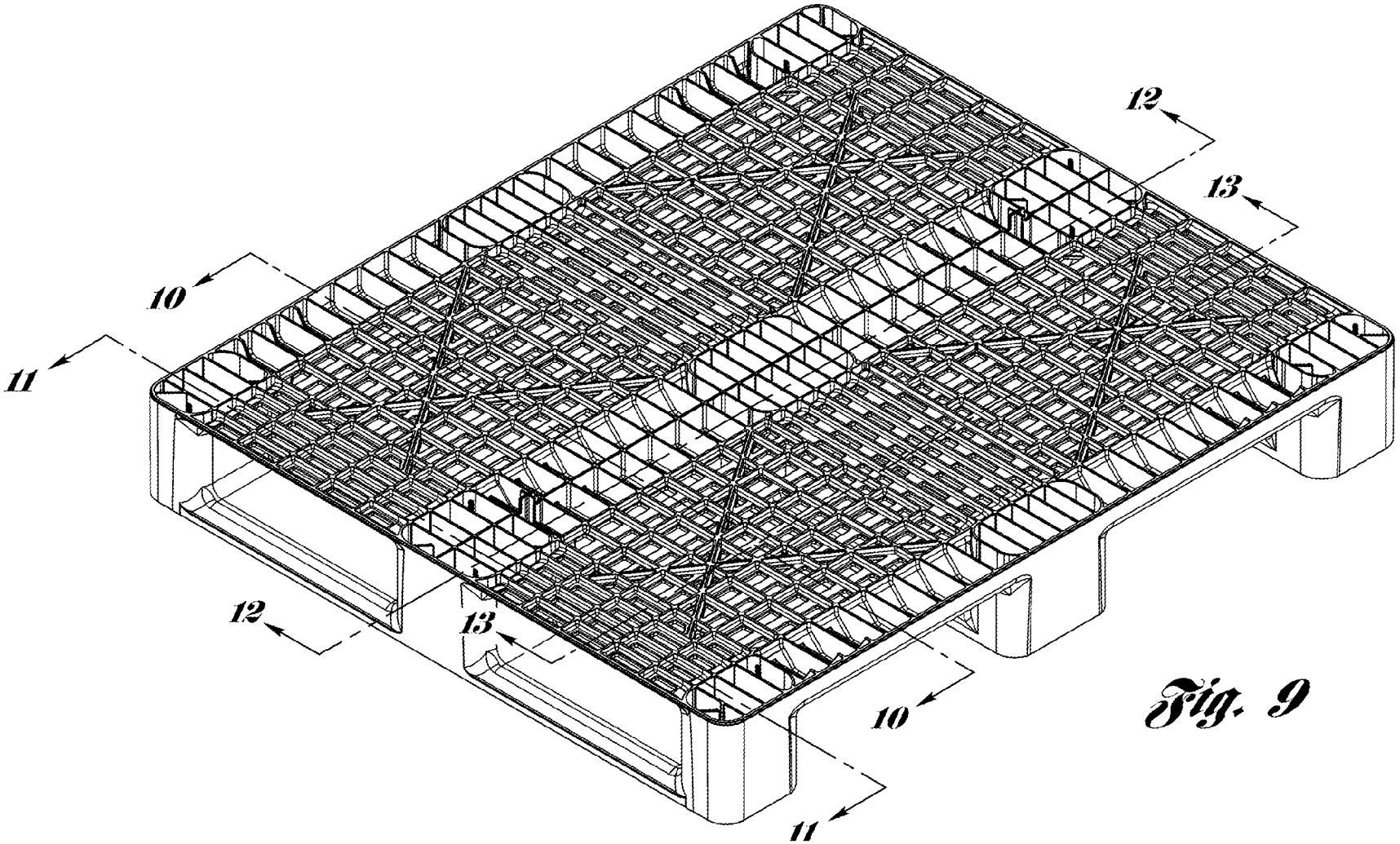
FIG. 9 is a bottom perspective view of the top deck of the pallet.
Figure 10A:
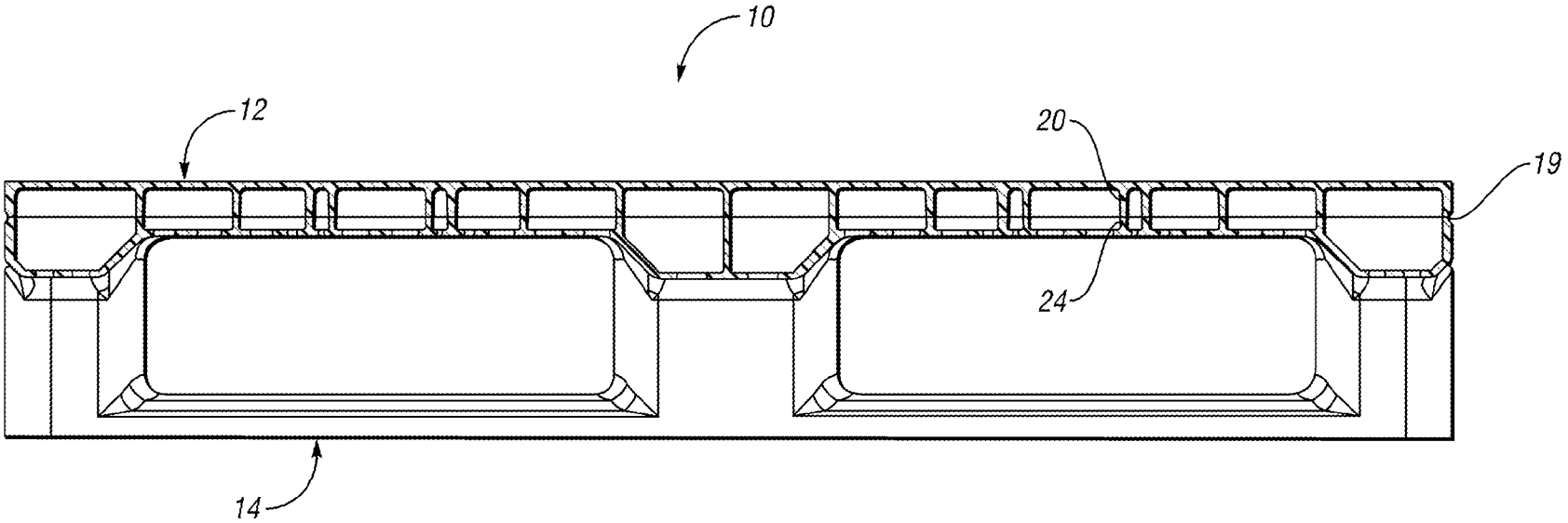
FIGS. 10*a* (attached), 10*b* (spaced apart) show across-sectional view taken 10 along the line 10-10 of FIG. 9.
Figure 10B:
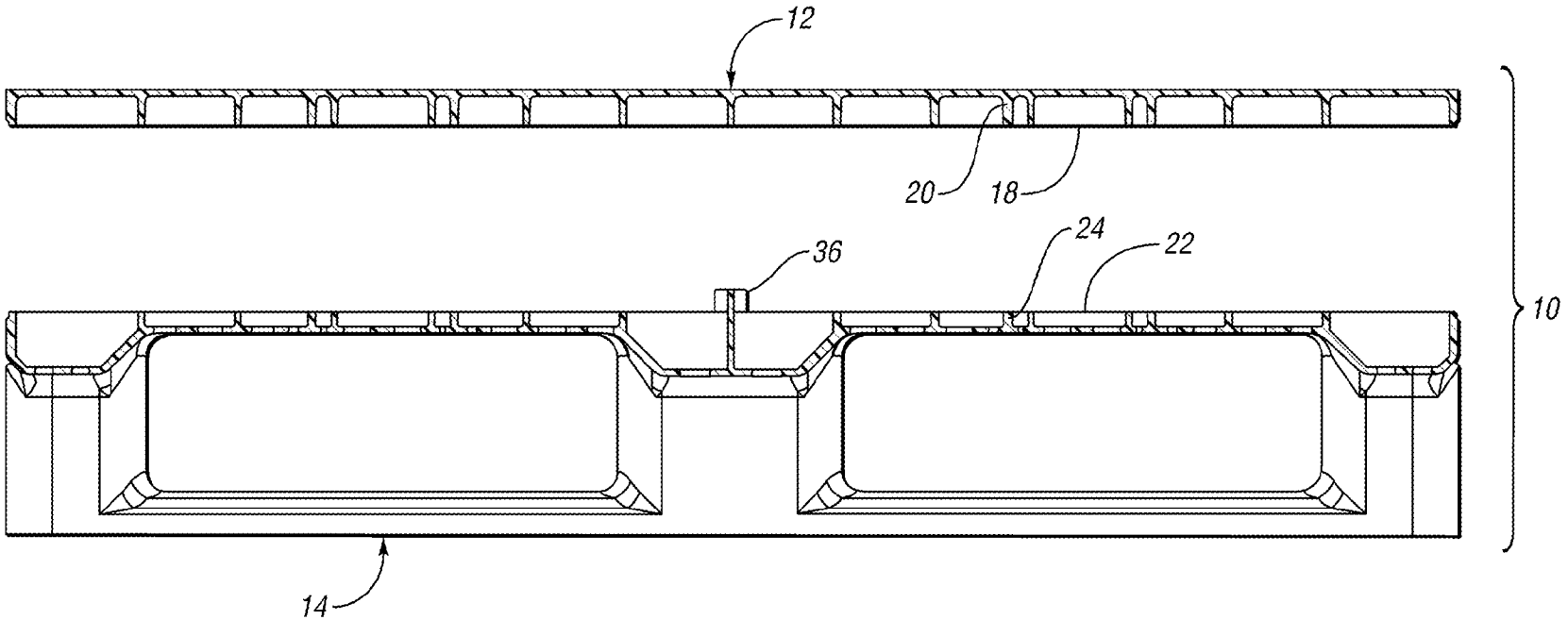
Figure 11A:
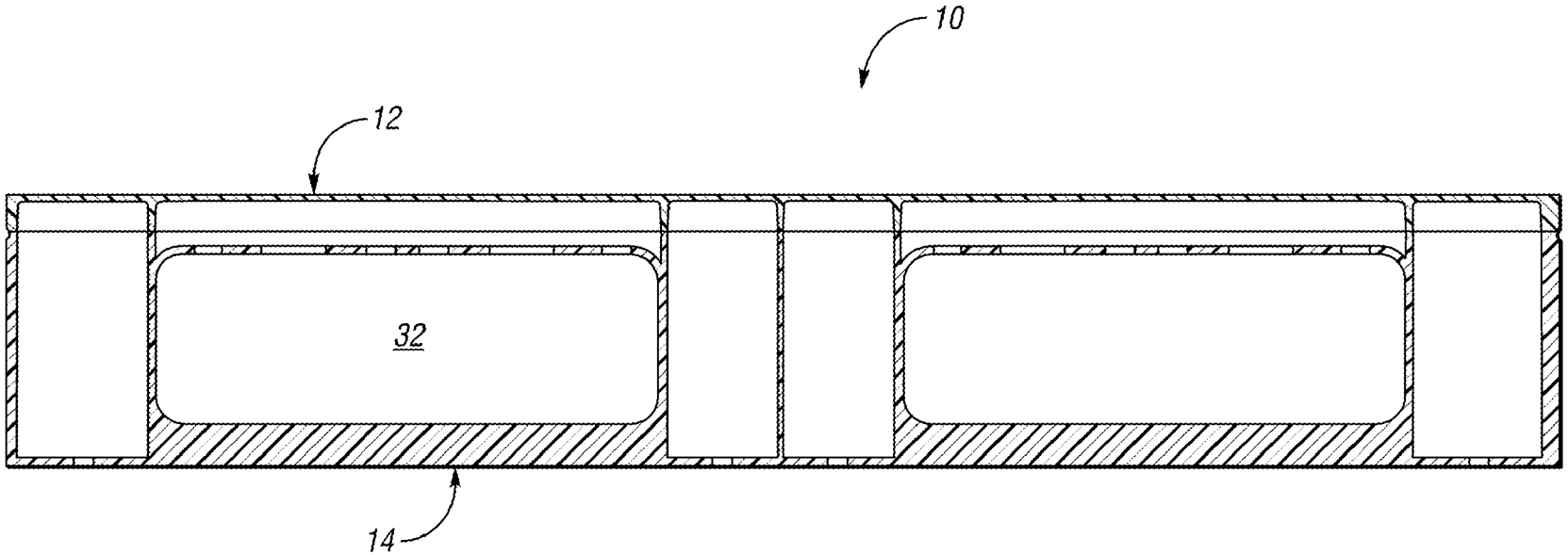
FIGS. 11*a* (attached), 11*b* (spaced apart) show a cross-sectional view taken along the line 11-11 of FIG. 9.
Figure 11B:
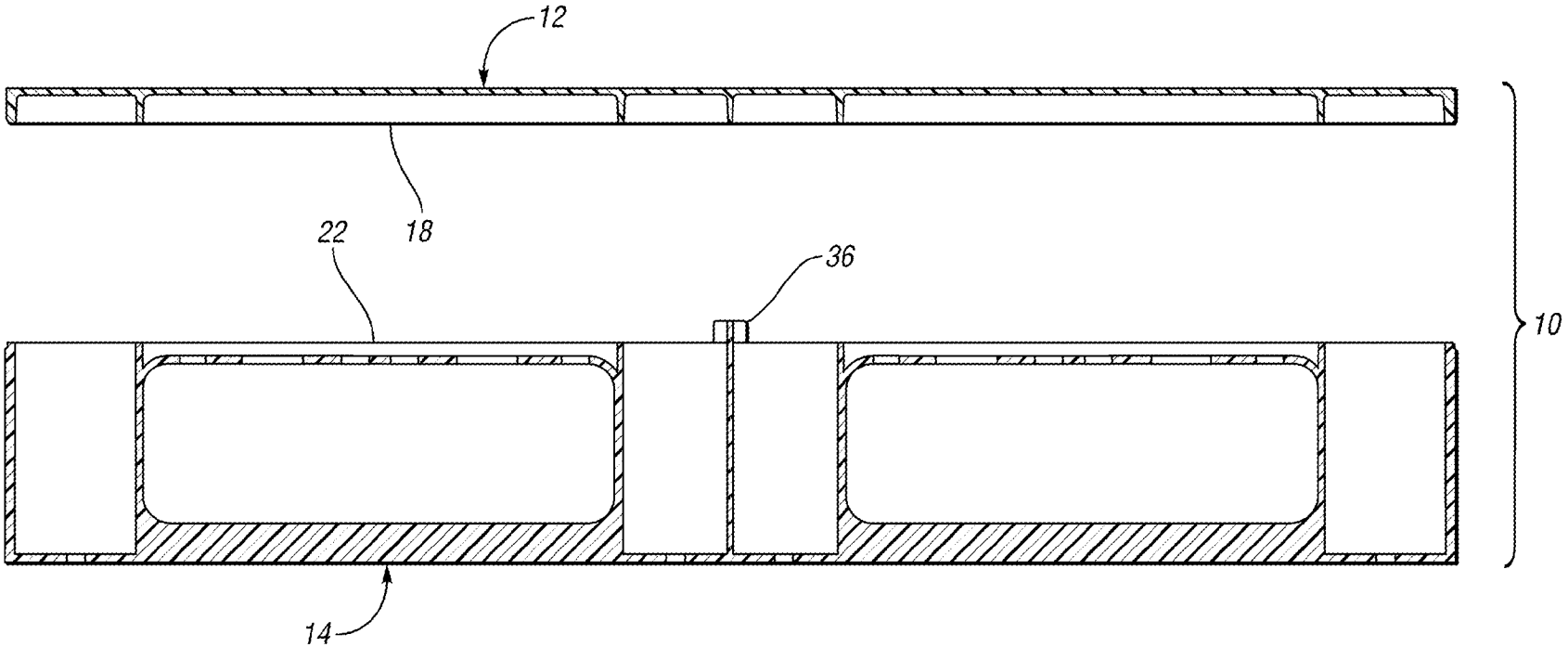
Figure 12A:
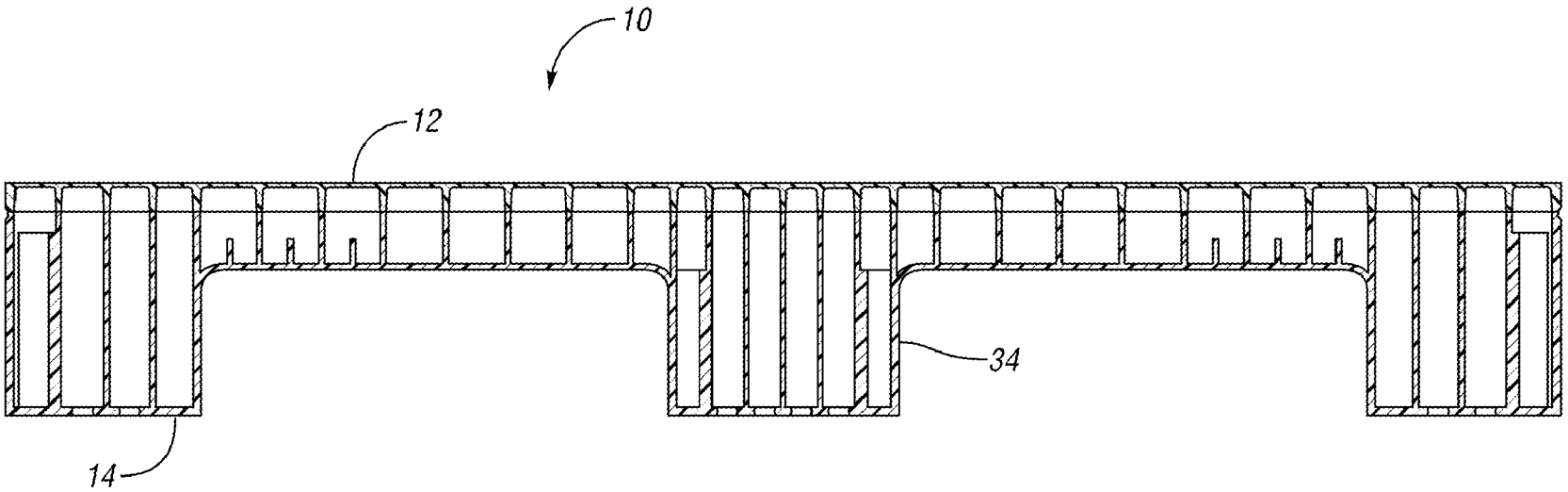
FIGS. 12*a* (attached), 12*b* (spaced apart) show a cross-sectional view taken along the line 12-12 of FIG. 9.
Figure 12B:
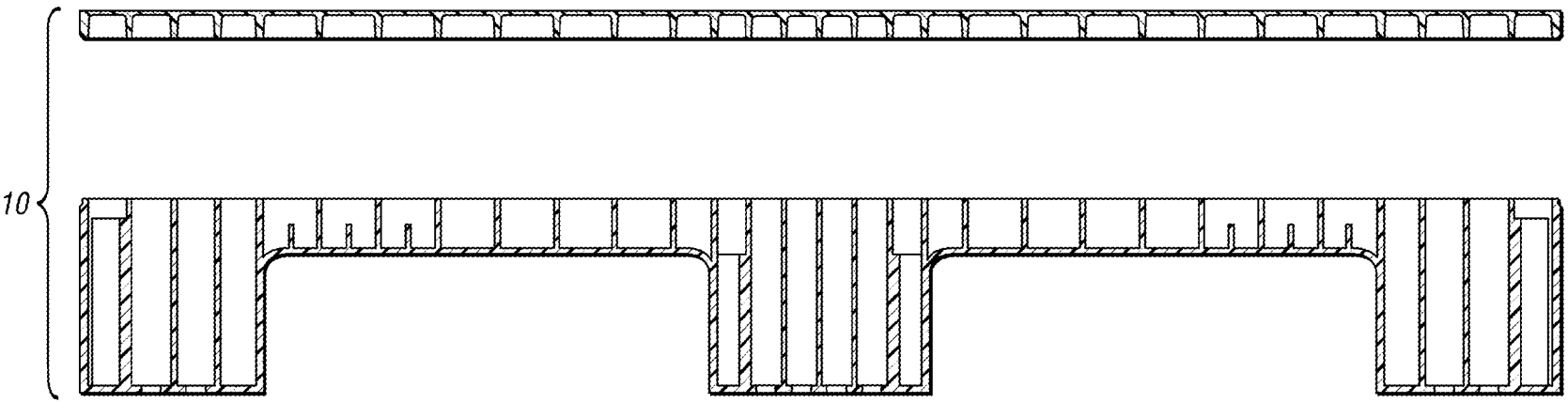
Figure 13A:
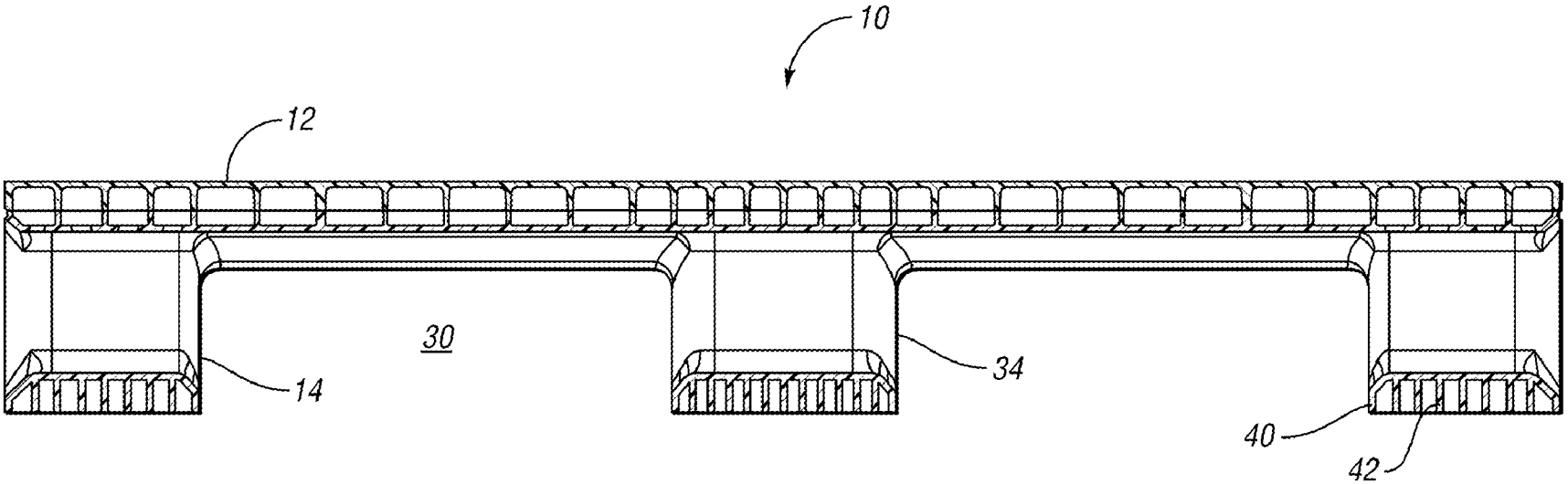
FIGS. 13*a* (attached), 13*b* (spaced apart) show a cross-sectional view taken along the line 13-13 of FIG. 9.
Figure 13B:
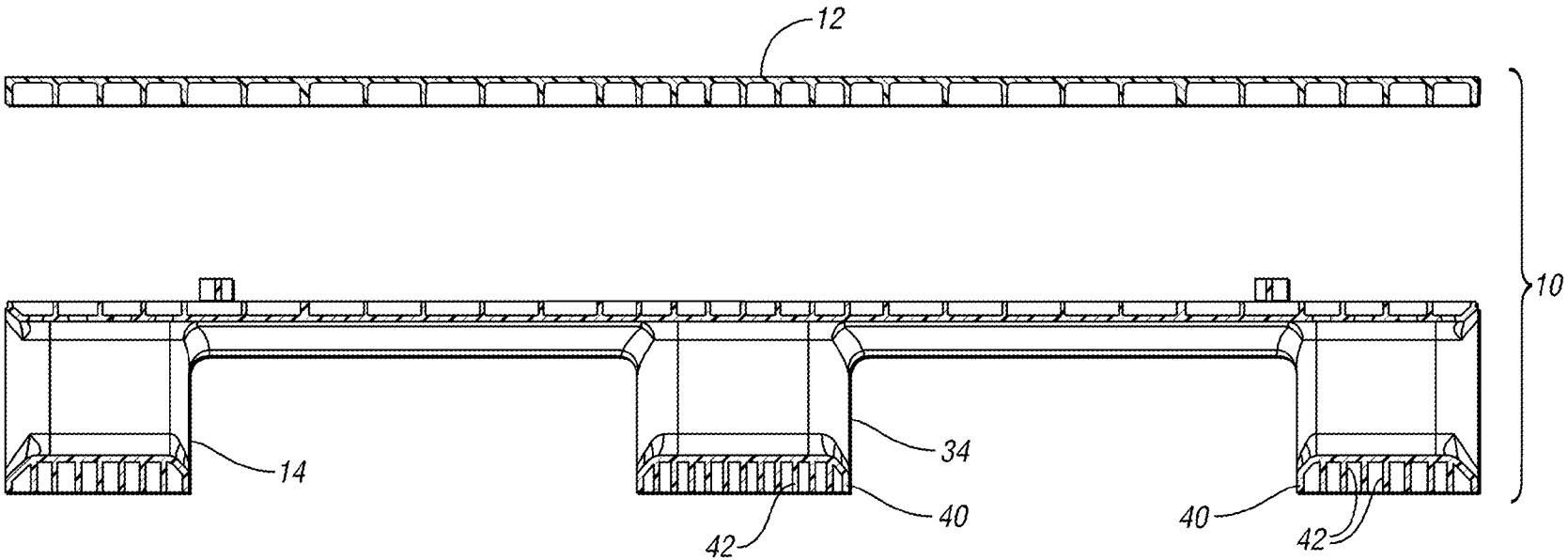

FIGS. 10*a*, 10*b*, 11*a*, 11*b*, 12*a*, 12*b*, 13*a*, and 13*b* illustrate cross-sectional views taken generally along corresponding lines shown in FIG. 9, which FIGS. 10*a*, 11*a*, 12*a*, and 13*a* show the decks attached, while the corresponding "b" Figures shown the decks spaced apart. While FIG. 9 does not show a top deck 12, it is representative of where the section lines are taken in the pallet assembly 10. Specifically, FIGS. 10*a,b* are taken along the line 10-10 of FIG. 9 through a notched area 30 of pallet 10, with FIG. 10*a* showing the mating ribs 20, 24 of top deck 12 and the upper portion of bottom deck 14 attached to each other. FIGS. 11*a,b* are also taken transversely across the pallet along line 11-11 of FIG. 9 through runners 28, and through posts 34 which illustrates that the ribbing of bottom deck 14 extends from bottom deck upper surface 22 through the vertically disposed posts and to the bottom of runners 28. FIGS. 12*a,b* is a cross-sectional view taken along the line 12-12 of FIG. 9, and is taken longitudinally across pallet 10 generally parallel to the centerline of pallet 10. As shown in FIG. 12, the rib pattern through this section extends between the top surface and bottom surface of pallet 10, through top deck 12 and bottom deck 14. FIG. 13 is a cross-sectional view taken along the line 13-13 of FIG. 9, and is taken through front and rear pallet openings 32. FIG. 13 shows the mating cross-rib members of top deck portion 12 in the upper areas of bottom deck portion 14. FIG. 11 also shows the ribbing pattern 42 of transverse support members 40.

Figure 7:
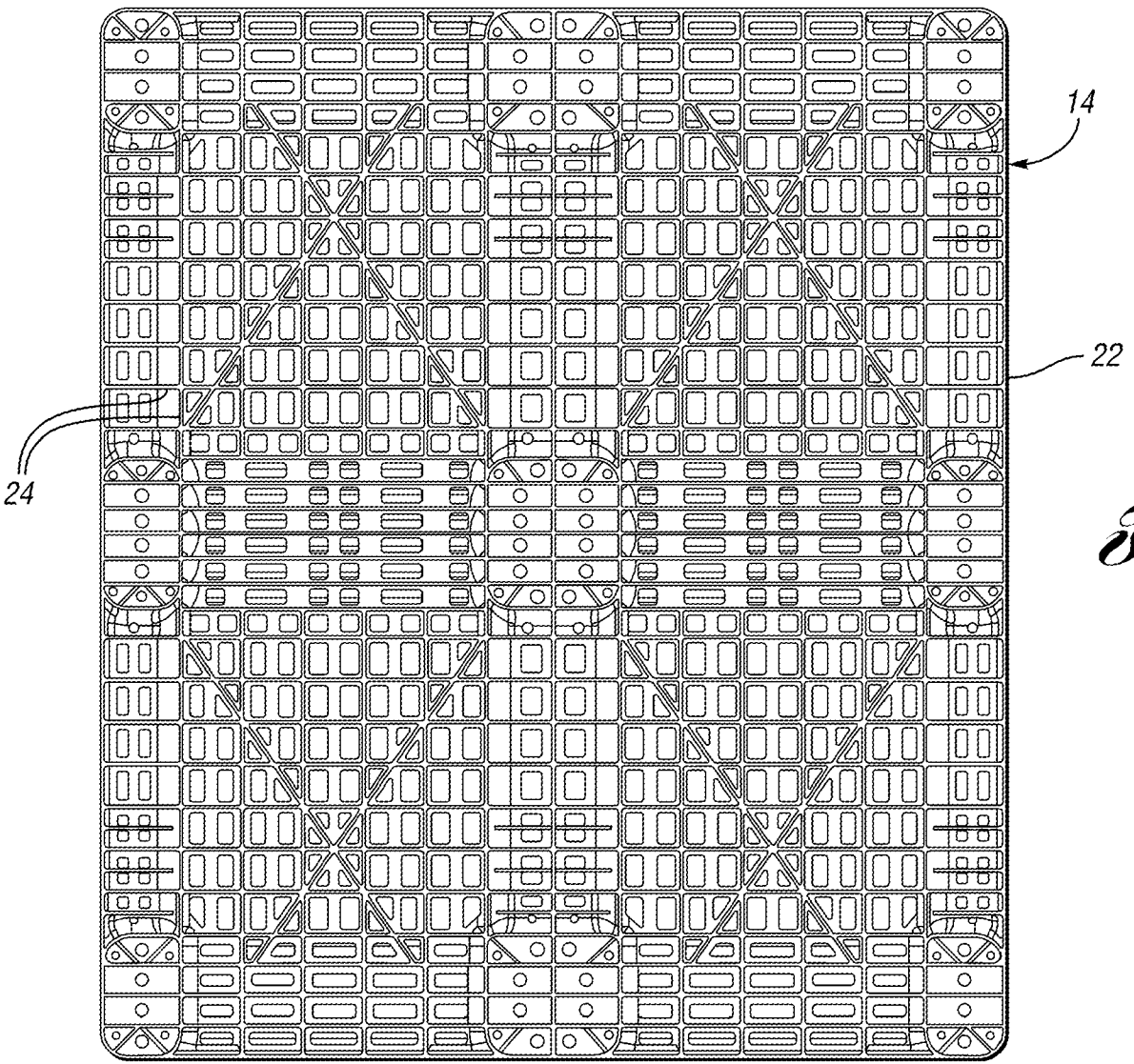
FIG. 7 is a top plan view of the bottom deck of the pallet.

As shown in FIGS. 6-7 and 10*b*, pallet 10 may also include a locating feature between the upper and lower decks in order to make the assembly and welding processes more efficient. Specifically, one of the decks includes at least one locating projection member 36 projecting from its surface, while the mating surface of the other deck includes a corresponding recess 38 (FIGS. 6 and 8), such that during assembly, the recess 38 receives the projection member 36.

Figure 14:
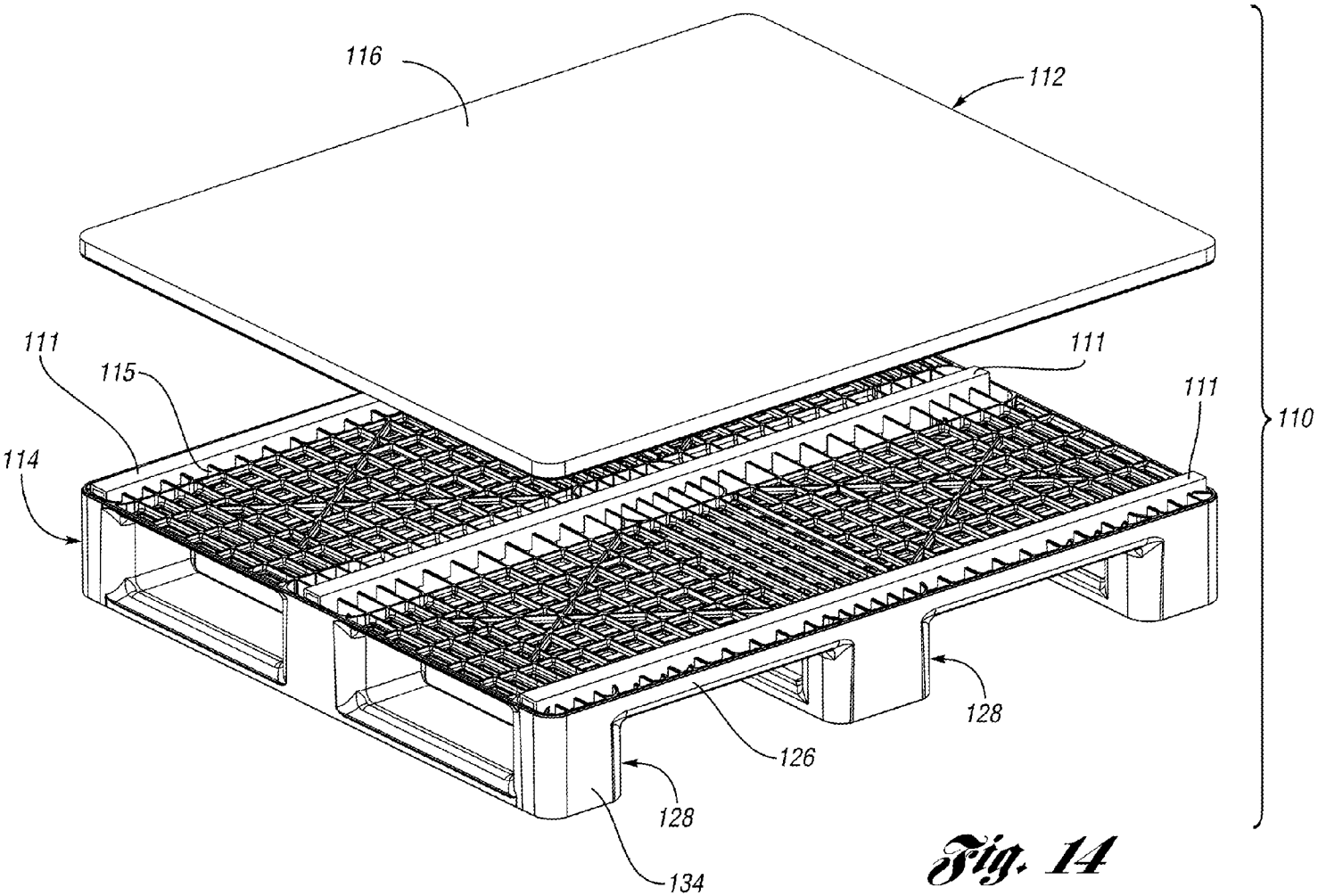
FIG. 14 is an exploded perspective view of the pallet of FIG. 1, with reinforcement members added.
Figure 15:
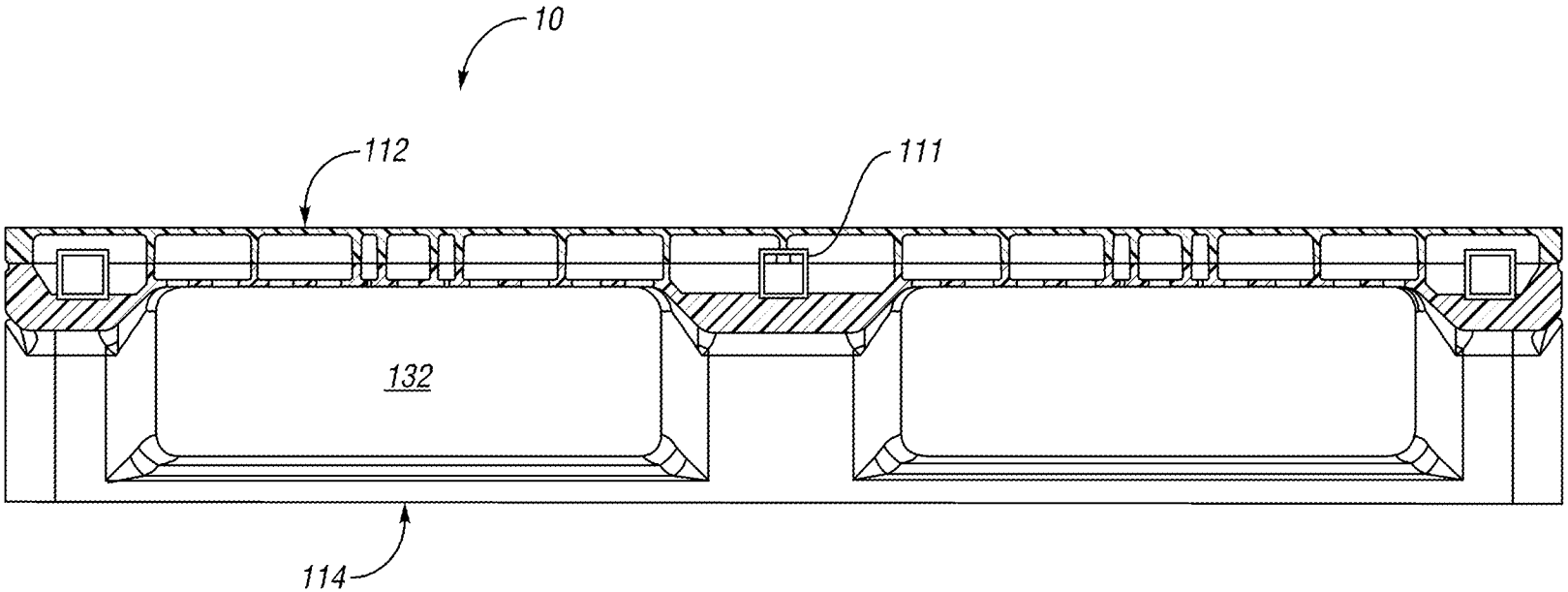
FIG. 15 is a cross-sectional view taken in FIG. 14, which section is similar to FIG. 10*a*.
Figure 16:
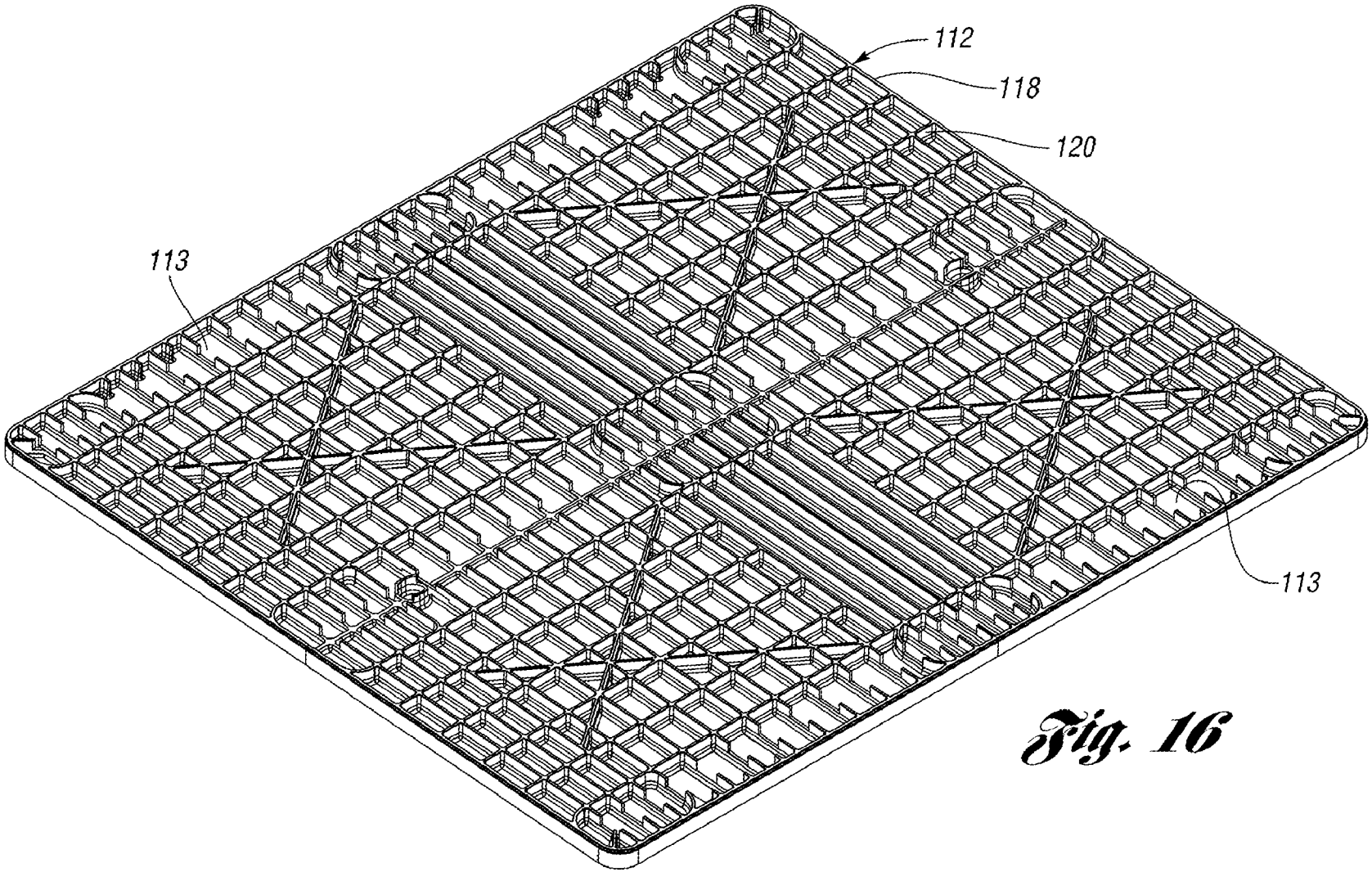
FIG. 16 is a bottom perspective view of the top deck of the pallet shown in FIG. 14.

FIGS. 14-16 illustrate a pallet 110 (similar to pallet 10 of FIGS. 1-13) having at least one reinforcement member 111 formed therein. The references numbers shown therein correspond generally to those of FIGS. 1-13, with the addition of a "1" prefix. As shown in FIG. 14, pallet 110 is shown having three longitudinally extending reinforcement members 111 disposed between top deck 112 and bottom deck 114. Reinforcement member 111 may be formed of various materials, such as a metal like steel or aluminum, or a composite material or structural plastic which is carbon-filled or glass-filled, or pultrusion. Reinforcement members 111 are oriented parallel to each other in a common plane and are aligned with post members 134 in a direction substantially perpendicular to that in which runners 128 extend. Thus, while runners 128 provide pallet 110 with the desired racking strength in the direction in which they are oriented, reinforcement members 111 provide enhanced strength and rigidity to pallet 110 in the direction perpendicular to runners 128. As illustrated in FIGS. 14-16, reinforcement members 111 are received by channels 113, 115 formed in the surfaces 118, 122 of the corresponding top and bottom decks 112, 114. (Channel 113 best shown in FIG. 16). Members 111 are secured between the decks when the ribs 120, 124 surrounding reinforcement members 111 are attached together as heretofore described.

Accordingly, the teachings herein provide pallets 10, 110 with the desired strength, package height, weight, and racking strength.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet comprising:

a top deck member having an upper surface, and a lower surface defined by a plurality of generally transverse first cross-rib members; and a bottom deck member having an upper portion and a plurality of runners extending downwardly from the upper portion in a unitary construction, the upper portion having an upper surface defined by a plurality of generally transverse second cross-rib members corresponding generally to the first cross-rib members and attached thereto to securely attach the top deck and bottom deck to each other, the runners extending transversely across the pallet in a generally parallel orientation and having a lower surface, the runners further having a plurality of upright members and support members extending between the upright members and integrally formed therewith in a unitary construction, wherein the plurality of second cross-rib members extend from the upper surface of the bottom deck to the lower surface of the runners.

2. The pallet of claim 1, wherein the support member has an upper support surface and a lower support surface, wherein one of the upper support and lower support surfaces is defined by a plurality of rib members.

3. The pallet of claim 2, wherein the lower support surface is defined by a plurality of rib members.

4. The pallet of claim 1, wherein the first and second cross-rib members are attached to each other by a welding process.

5. The pallet of claim 1, wherein the bottom surfaces of the upright members and support members are co-planar.

6. The pallet of claim 1, wherein at least one of the lower surface of the top deck and the upper surface of the bottom deck have at least one channel formed therein for receiving at least one reinforcement member therein.

7. A pallet comprising:

a first deck member having an upper surface arranged for receiving a load thereupon, and a lower surface having a first plurality of cross-ribs; and a second deck member having a horizontally disposed upper portion with a lower surface, and an upper surface defined by a second plurality of cross-ribs corresponding generally to and mating with the first plurality of cross-ribs, the second deck further having a lower portion integrally formed with the upper portion to form a unitary construction therewith, the lower portion extending downwardly from the upper portion and defined by a plurality of generally parallel runners for supporting the pallet, the runners spaced apart from each other to define openings therebetween, each runner having a plurality of post members and at least one support member extending between the bottom of the post members for interconnecting the posts members in a unitary construction, the first cross-ribs and the second cross-ribs extending continuously from the upper surface of the first deck member through the post members to a lower surface of the runners.

8. The pallet of claim 7, wherein the support member has and upper support surface and a lower support surface, wherein one of the upper support and lower support surfaces is defined by a plurality of rib members.

9. The pallet of claim 8, wherein the lower support surface is defined by a plurality of rib members.

10. The pallet of claim 7, wherein the first and second plurality of cross-ribs are attached by a welding process.

11. The pallet of claim 7, wherein the bottom surfaces of the post members and support members are co-planar.

12. The pallet of claim 7, wherein at least one of the lower surface of the first deck and the upper surface of the second deck have at least one channel formed therein for receiving at least one reinforcement member therein.

13. The pallet of claim 7 wherein the upper portion is integrally molded with the plurality of runners as the unitary construction.

14. The pallet of claim 1 wherein the upper portion is integrally molded with the plurality of runners as the unitary construction.

* * * * *